US005078595A

United States Patent [19]

Roenigk et al.

[11] Patent Number: 5,078,595

[45] Date of Patent: Jan. 7, 1992

[54] CARBON FLUE WALL AND METHOD OF MAKING

[76] Inventors: Howard L. Roenigk, 891 Winfield Rd., Cabot, Pa. 16023; Peter R. Frazier, 1204 N. 4-Mile Run, Austintown, Ohio 44515

[21] Appl. No.: 537,211

[22] Filed: Jun. 15, 1990

Related U.S. Application Data

[63] Continuation-in-part of Ser. No. 380,004, Jul. 14, 1989, abandoned.

[51] Int. Cl.[5] ..... F27B 5/02; F27B 5/16

[52] U.S. Cl. ..... 432/164; 432/192; 432/193; 110/211

[58] Field of Search ..... 432/192–194, 432/164, 238, 252; 110/211

[56] References Cited

U.S. PATENT DOCUMENTS

| | | | |
|---|---|---|---|
| 1,645,011 | 10/1927 | Kinney . | |
| 2,213,687 | 9/1940 | Brassert . | |
| 2,384,859 | 9/1945 | Thayer . | |
| 3,458,641 | 7/1969 | Perucchetti . | |
| 4,040,778 | 8/1977 | Black | 432/192 |
| 4,253,823 | 3/1981 | Holdner | 432/192 |
| 4,269,592 | 5/1981 | Benton et al. | 432/192 |
| 4,364,798 | 12/1982 | Costa . | |
| 4,552,530 | 11/1985 | Gunnes et al. | 432/164 |
| 4,859,175 | 8/1989 | Dreyer et al. | 432/193 |

*Primary Examiner*—Henry C. Yuen

*Attorney, Agent, or Firm*—Howson and Howson

[57] ABSTRACT

A flue wall, and method for making same, adapted to be readily assembly with like walls and other components to form a battery of heated comparments in a pit in which carbon anodes, such as used in the manufacture of alumina are baked. The wall includes upper and lower sections each having two interlocked parallel panels, of pre-cast monolithic construction. The upper and lower sections interfit to form a hollow flue confining the flow of hot gases generated by fuel burners. Baffles across the flue channel the gases in a serpentine-like path. Inclined apertures at spaced locations permit gases envolved by the anodes as they bake to flow into the flue and combust with the hot gases from the burners. Lifting lugs are provided to enable the wall to be fabricated at a site remote from the bake pit and transporated to the pit in form. In one embodiments the panels in each section have symmetrical interfacing reliefs of baffles, vacuum supports and edgewall portions to facilitate casting and assembly.

3 Claims, 7 Drawing Sheets

CARBON FLUE WALL AND METHOD OF MAKING

REFERENCE TO RELATED APPLICATION

This is a continuation-in-part of copending U.S. Pat. application Ser. No. 07/380,004 filed July 14, 1989, now abandoned.

FIELD OF THE INVENTION

The present invention relates generally to large industrial carbon baking ovens, and more particularly, the present invention relates to refractory flue walls for use in such ovens and to a method of manufacturing such walls.

BACKGROUND OF THE INVENTION

In the process of converting bauxite ore into alumina, electricity is passed through a bath by means of large carbon blocks which act as anodes. These blocks, normally two to four in number are affixed to a metal holder located above the bath so that the blocks depend into the bath to provide electrical conduction. In use, the blocks erode and require periodic replacement. In a typical alumina production plant, several hundred carbon blocks are consumed each day. Because of this, the blocks are usually manufactured on-site where they are consumed. In fact, entire departments are devoted entirely to the pressing and baking of carbon blocks.

It is desirable for the carbon blocks to have as long a service life as possible. However, the primary factor which adversely affects the service life is erosion, usually due to improper baking. In making a block, which usually weighs between about 350 and 550 lbs., carbon particles are pressed in a large ram press and are bonded together by a tar-like bonding agent. The block forms are then placed into a baking oven where the volatile binding agent is driven off a the carbon block is baked. Usually, the baking process occurs over about a 14- to 28-day cycle.

The typical carbon block baking oven comprises a large oblong rectangular pit, almost the length of a football field, with a poured concrete bed and walls contained within a corresponding large shed, or building. The pit is subdivided by a series of vertical crosswise refractory headwalls and lengthwise flue walls to form a battery of baking chambers in columns and rows in which the blocks are stacked and covered by loose granular material. Heat is then applied by conduction and radiation through the flue walls. Each flue wall is fabricated of laid up refractory bricks on either side with a flue space between communicating end-to-end with adjacent walls through apertures in the headwalls. A cover on the flue wall includes a series of lengthwise-separated ports, sealed by removable caps, for receiving fuel oil or gas burners which direct flame downwardly into the flue space. Cracks between the refractory bricks forming the flue walls permit volatiles given off from the carbon block bonding agents to pass into the flue space where they are ignited by the hot gases from the burners and provide additional heat for the baking process. The combined hot gases from the burners flow through row to row of lengthwise walls and the apertures in the headwalls and exit at the opposite end of the pit. The burners are periodically advanced lengthwise of the pit as the baking cycle progresses in a manner well known in the art.

The construction of a carbon baking oven as aforedescribed is a labor-intensive undertaking. Current practice in some installations involves the construction of each wall, including the flue walls, in situ in the pit. Depending on the size of the flue wall, each may comprise between 1,000 and 2,000 refractory bricks, and 16 to 30 man-hours to build. Considering that the construction must be undertaken in cramped space, and under dusty and dirty conditions, such a mode of construction is not as efficient as desired.

In other installations, the flue walls are constructed at one end of the building housing the pit, or near where they will be used, and transported to the pit where they are lowered into place. This necessitates the use of extra heavy-duty cranes and lifting equipment to transport the wall. In addition, the all-brick construction must be supported under the very bottom to ensure against fracture when lifted into place. The wall is therefore built on a steel member which is usually left in place after the wall is set. Sometimes these members can be retrieved and reused after a wall is removed for replacement.

The service life of a typical oven installation constructed as described above ranges from two to fifteen years. Generally, failure occurs most frequently in the flue wall. Failure is not usually due to refractory disintegration, but rather because the walls lose integrity and start to bow sideways. This bowing closes the space between the flue walls, and where the gap is closed too much, there is insufficient room for placing the carbon blocks for baking. Bowing of one wall will also cause an adjacent wall to bow very similar to a domino effect.

The major factor contributing to flue wall life depends on how quickly the pit is turned around. Turnaround time is the time from when the pit is emptied to when it is again refilled with carbon blocks and refired. Usually, the shorter the turnaround time, the shorter will be the service life of the flue wall as there is no time to repair any cracks or do any maintenance on the wall. This is because each cycle involves heating and cooling the refractories to remove the blocks.

Depending upon the capacity of the alumina production facility, and the through-put of the baths which consume the carbon blocks, some alumina production facilities have baking ovens which have short service lives. For instance, when alumina production is at maximum, anodes are consumed frequently, thereby requiring more frequent replacement. This, in turn, requires increased production of carbon blocks. If baking capacity is limited, blocks may be baked for shorter periods or at higher temperatures in order to keep up with the requirement for finished blocks. Unfortunately, improperly cured blocks erode quicker, thereby increasing the demand for additional replacement blocks, the result being a process which is akin to a faster and faster running treadmill. Heretofore, alternatives have been cost prohibitive because they have involved either the construction of additional pits or the purchase of carbon blocks from outside vendors. When it is considered that an average alumina production plant can consume between 250 and 400 carbon blocks per day, and the present market value for carbon blocks is between about $350 and $550 each, it should be apparent that there is a need for another solution to this vexing problem.

Owing to labor-intensive requirements of refractory block installations, costs, service life and lost production due to shutdowns, prefabricated refractory modules have evolved to replace the brick flue walls. The flue walls are assembled in sections from interrelated parts pre-cast in monolithic refractory concrete. However, each part in a section is unique in order to form the various configurations of baffles, ports and crossties. Thus, many casting molds may be required to form the parts necessary for a complete flue section. In addition, the shapes of these parts often manifest relatively complex molds.

BRIEF DESCRIPTION OF PRIOR ART

U.S. Pat. No. 4,364,798 discloses a method and apparatus for repairing a coke oven heating chamber by forming in situ a monolithic wall of refractory material which is internally baffled to permit the passage of gas through the wall.

U.S. Pat. No. 1,645,011 and U.S. Pat. No. 2,384,859 both disclose furnaces having pre-fabricated wall sections.

U.S. Pat. No. 3,458,641 discloses a refractory lining for an arc furnace, the lining being segmented and shaped to afford ready disassembly upon completion of a campaign.

U.S. Pat. No. 2,213,687 discloses a tongue and groove wall panel of poured concrete construction.

U.S. Pat. Nos. 4,040,778, 4,253,823, 4,269,592, 4,552,530, and 4,859,175 disclose various configurations of carbon baking furnaces in which rows of flue walls are arranged end-to-end. Hot gases within the flues provide the heat necessary to bake carbon electrodes deposited between adjacent flue walls. U.S. Pat. No. 4,040,778 in particular utilizes refractory concrete wall sections assembled from precast monolithic parts.

While each of the aforementioned patented constructions may function satisfactorily for its intended purpose, none provides a solution to the problems discussed above which are solved by the present invention.

OBJECTS OF THE INVENTION

With the foregoing in mind, a primary object of the present invention is to provide a novel oven construction which is particularly suited to baking carbon anodes of the type that find utility in the process of manufacturing alumina.

Another object of the present invention is to provide an improved pre-cast flue wall construction which can be erected expeditiously and, therefore, economically.

A further object of the present invention is to provide a unique refractory carbon baking oven flue wall construction which is both durable and capable of being fabricated remote from the bake site, and assembled readily on the bake site with minimal skilled labor.

As a still further object, the present invention provides a unique method for manufacturing carbon baking oven wall components to enable them to be assembled readily in a location of intended use.

Another object of the present invention is to provide a precast refractory flue wall construction for a carbon baking oven which reduces the risk of premature failure resulting in a relatively long service life.

Still another object of the present invention is to provide a hollow refractory flue wall which enables the opposite sides to be separately cast in the same mold and joined together at reliefs formed in each side of complementary portions of bottom, top and end walls, baffles, spacers and the like, which tolerates relative thermal expansion of the wall at the joined surfaces, and which provides structural support between the sides.

SUMMARY OF THE INVENTION

More specifically, the present invention provides a pre-cast refractory flue wall for a carbon baking oven and a method of manufacturing the same. In a first embodiment, the flue wall is of cast refractory material and includes at least upper and lower sections adapted to engage one another top-to-bottom. Both sections have spaced parallel wall panels which cause the sections to be hollow. The sections have complementary baffle members which cooperate when the upper section is laid on top of the lower section, to define a serpentine flue through the wall between an inlet at one end and an outlet at the opposite end. Each of the wall panels has a series of relatively small diameter weep holes which incline upwardly toward the interior of the section for conducting volatiles into the flue. The bottom of the lower section is closed, and the top of the upper section is covered by a removable cap having ports for receiving fuel burners. The wall panels are interconnected at spaced intervals by refractory crossties. Removable lifting lugs are provided to enable the sections to be transported and assembled readily.

In a second embodiment, each of the upper and lower sections of the flue wall includes two identical panels spaced apart in parallel relation with interfacing reliefs of complementary portions of walls, baffles and vacuum supports symmetrically arranged about a vertical axis. Crossties cast in oppositely flaired apertures in the panels prevent the panels from spreading apart. Insulation paper lining the apertures and the interfacing baffle portions allow for thermal expansion. Inclined weepholes at selected locations in the panels allow gases released from the carbon blocks during baking to pass into the flue.

One preferred process of manufacturing a wall section according to the first embodiment includes casting one refractory panel in a form lying on its side having internal dimensions equal to the length, height and thickness of one panel with consumable forms for the crossties, baffles and weepholes. When set, a consumable form of internal dimensions equal to the other panel, with consumable forms for weepholes, is set on top of the one panel for casting the panel around the exposed ends of the crossties. The combined panels are finally heat cured in a conventional manner with the consumable forms destroyed in the process.

In another preferred process for making the first embodiment, one panel is cast in a mold of the appropriate length, height and thickness lying on its side with consumable forms for the crossties, baffles and weepholes. After the refractory sets, the panel is inverted over another mold, the length, height and thickness of the opposite panel, lying on its side with consumable forms for the weepholes. The panels are maintained in spaced relation by the ends of the crossties abutting the bottom of the second mold. Castable refractory is then poured into the second mold to form an integral wall section, interlocked by crossties, and finally heat cured in a conventional manner.

A preferred process for manufacturing a lower wall section for the second embodiment includes casting two identical refractory panels with the baffle and vacuum support portions using the same mold or two identical molds. Consumable cores provide the weepholes and flaired holes for the crossties. When set, the crosstie cores are removed, and the panels are interfaced with insulation paper between opposing vacuum support portions and with cylindrical crosstie forms between opposing flaired holes. The panels are mortared together at the interfacing end and bottom wall and support portions. Castable refractory is poured into the crosstie forms, and the assembled section heat cured in a conventional manner. The process is substantially the same for the upper section except for the mold configuration. At the oven site, the upper and lower walls and a pre-cast cover are finally assembled in place with mortar at the interfacing joints.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
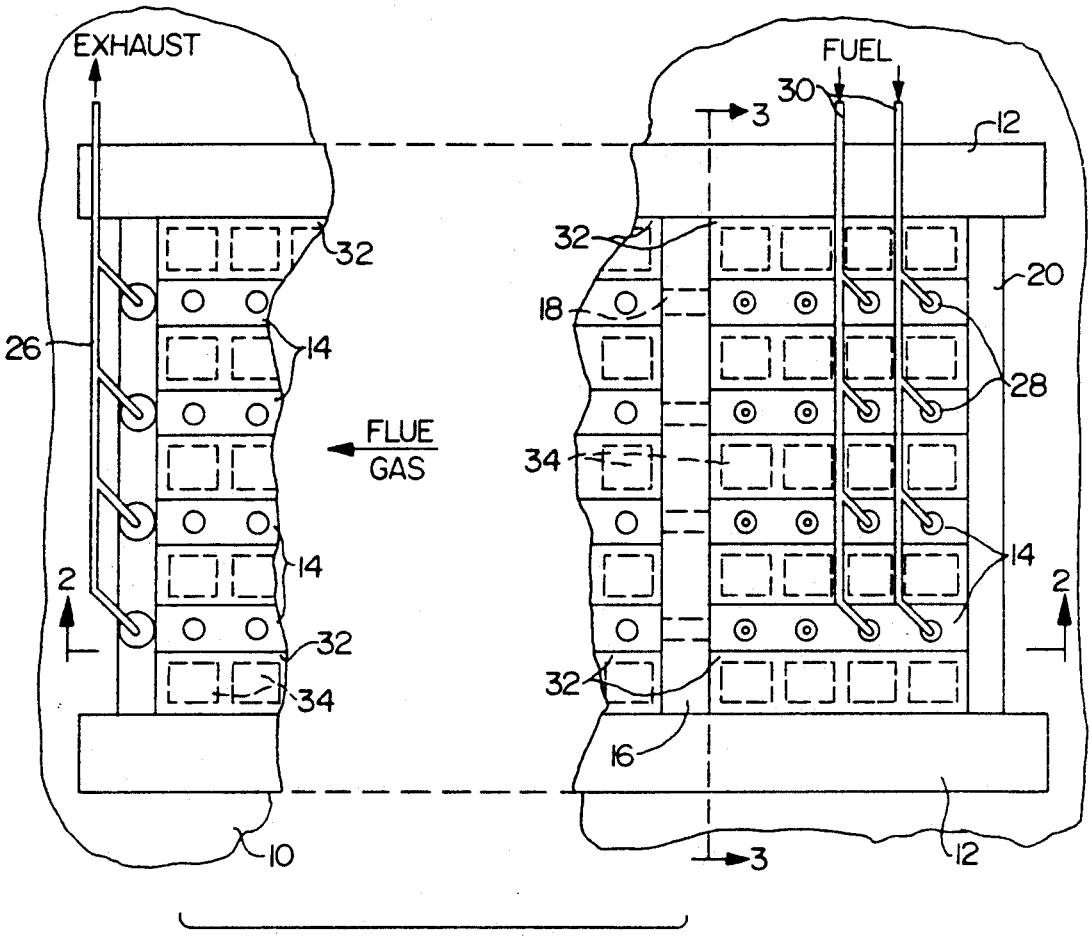
FIG. 1 is a schematic plan view of a carbon block baking oven utilizing one embodiment of a pre-cast flue wall constructed according to the present invention.
Figure 2:
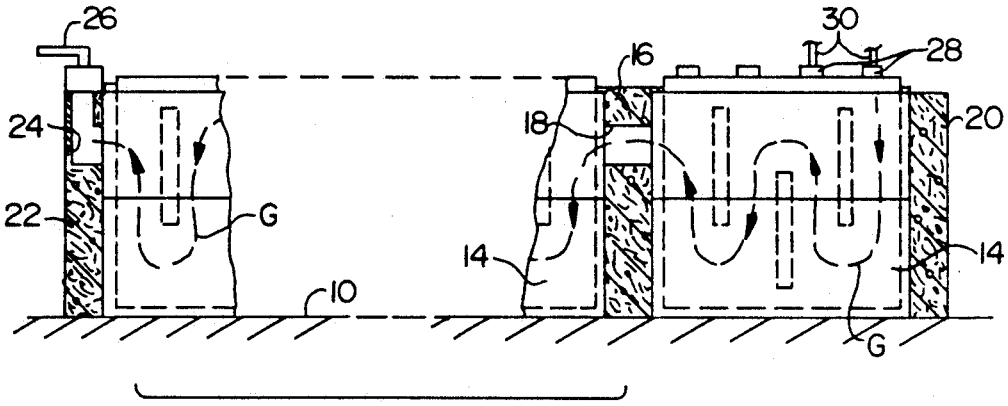
FIG. 2 is a longitudinal elevational view, partially sectioned, of the baking oven taken on line 2—2 of FIG. 1.
Figure 6:
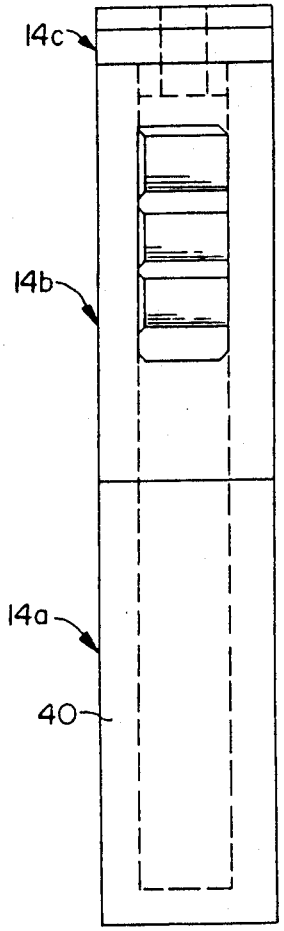
FIG. 6 is an end view of the flue wall taken on the line 6—6 of FIG. 5.
Figure 7:
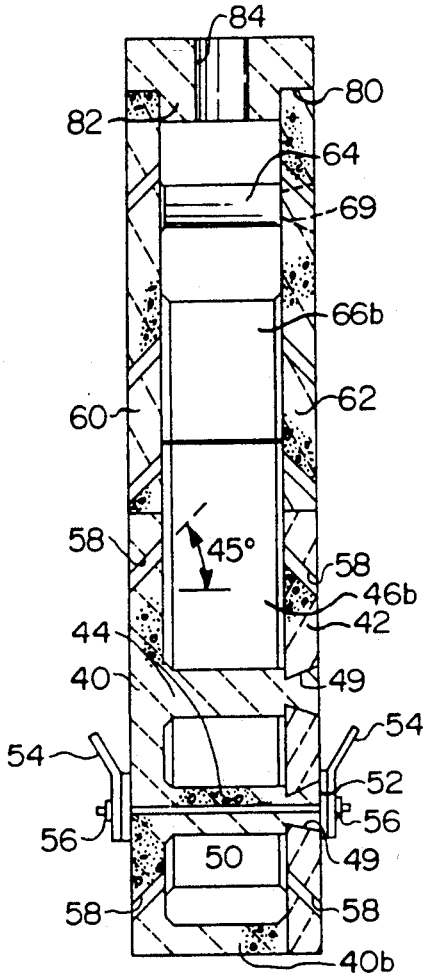
FIG. 7 is a sectional view of the flue wall taken along the irregular line 7—7 of FIG. 5.
Figure 3:
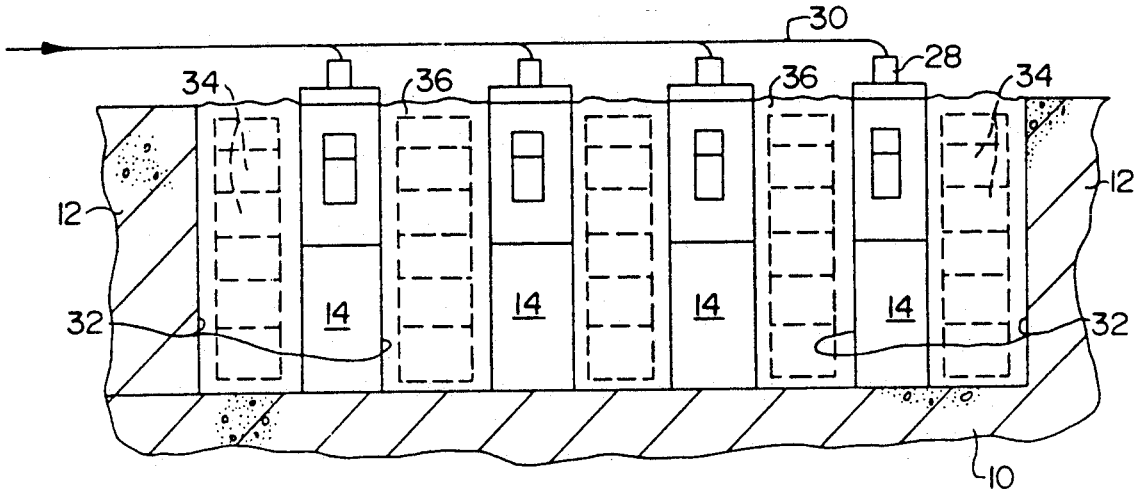
FIG. 3 is a transverse sectional view of the baking oven taken on line 3—3 of FIG. 1.
Figure 4:
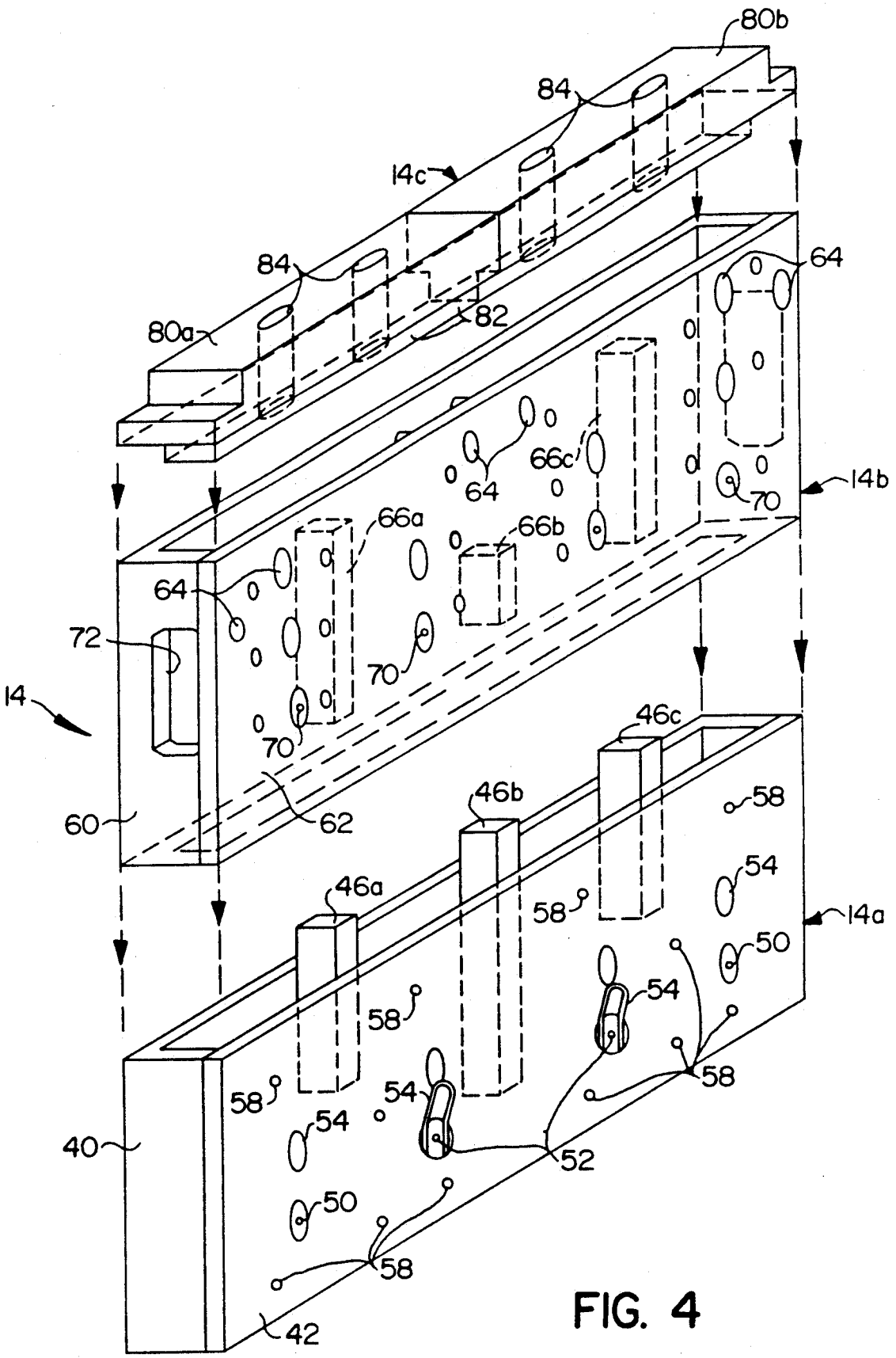
FIG. 4 is an exploded perspective view of the flue wall of FIG. 1.

Referring now to the drawings wherein like characters designate like or corresponding parts throughout the several views, FIGS. 1, 2 and 3 are schematic representations of one embodiment of pre-cast flue walls according to the invention in a carbon anode baking oven suitable for on-site use at an aluminum production plant. The oven is bounded on the bottom of a pit by a concrete rectangular bed 10 with walls 12 on either side. A plurality of oblong rectangular-shaped refractory flue walls 14 with hollow interiors for confining flue gases are arranged end-to-end on bed 10 in columns parallel to walls 12 and spaced side-by-side in rows between walls 12 to form a battery of heating zones. A refractory headwall 16 between each row of flue walls 14 includes apertures 18 spaced the length thereof connecting the interiors of adjacent flue walls 14 of each column. One end of the baking pit includes a concrete end wall 20 and the other end an exhaust header 22 with apertures 24. Burners 28 fed by fuel lines 30 direct flames through aligned ports into the interior of each flue wall 14 in a selected row. As shown by the arrows in FIG. 2, the combustion gases at burners 28 flow through each column of flue walls 14 and apertures 18 and 24 in a serpentine-like path G to an exhaust manifold 26.

The spaces in each row, bounded by adjacent flue walls 14 or by flue walls 14 and side walls 12, define baking chambers 32 in which carbon blocks 34 are arranged in stacks surrounded by a granular carbon powder 36 for conducting heat from the sides of flue walls 14 to the carbon blocks 34 while permitting gases to escape from blocks 34.

A more detailed description of flue walls 14 will be better understood with reference to FIGS. 4–7. Flue walls 14 each comprises a lower section 14*a*, an upper section 14*b* and a cover section 14*c* which interface to form a generally rectangular outer configuration, typically about 15 feet long, 12 feet high, and 20" wide. Some situations may permit or require more or less than three sections. Lower section 14*a* includes two interlocking monolithic refractory panels 40 and 42, each approximately 4½ thick, spaced apart by end and bottom edgewalls 40*a* and 40*b*, cylindrical crossties 44, and vertical baffle sections 46*a*, 46*b* and 46*c*, all being integrally formed with panel 40. Panels 40 and 42 are interlocked at the distal end of crossties 44 which taper outwardly into correspondingly tapered holes 49 in panel 42. Crossties 44, typically 6" and 9" in diameter, also provide at selected positions between panels 40 and 42 improved rigidity in panel areas of high stress. Lifting provisions for transporting or setting section 14*a* in place include through holes 50 formed in selected ones of crossties 44, preferably crossties close to the bottom of section 14*a*. Steel rods 52, threaded at the ends, are inserted in through-holes 50 and extend from the ends of crossties 44 for attaching lifting lugs 54 by nuts 56. Lugs 54 each define a steel plate with loops for attachment to lifting equipment, not shown. The lugs and rods are removed after placement of section 14*a* in the pit.

As aforementioned, gases are given off into the powder 36 by carbon blocks 34 as they are being baked. There being no cracks for escape of the gases in the monolithic construction of flue walls 14, weepholes 58 are cast in panels 40 and 42 to provide passages for the gases to flow into the interior of flue walls 14 where they are burned when exposed to the hot combustion gases from burner 28. Weepholes 58 slope upward from the exterior of side panels 40, 42 to the interior flue space. In the present construction, weepholes 58 are approximately ⅜ diameter and slope upward 45°. Preferably, the weepholes are located on center to center spacings ranging from about 18" to about 36".

Baffle sections 46 and 48 are spaced along the length of lower section 14*a* with sections 46 on either side of section 48, and project above the rims of panels 40 and 42. The lower ends of baffle sections 46 extend approximately halfway into the flue space while baffle section 48 extends substantially all the way.

The upper section 14*b* is similarly constructed with parallel interlocking panels 60 and 62. Integrally formed with panel 60 are end edgewalls 60*a*, crossties 64, and baffle sections 66*a*, 66*b*, 66*c* for maintaining a flue space between panels 60 and 62. Interlocking is provided by tapered ends on crossties 64 fitted in holes 69. Holes 70 cast through selected ones of crossties 64 are formed to receive rods 50 for attachment of lifting lugs 54 in the manner described for in lower section 14*a*. End edge walls 60*a* have recesses 72 which form with panel 62 inlet and outlet openings 72*a* and 72*b*, respectively, for allowing the hot gases to flow through the flue space. Baffle sections 66*a* and 66*c* extend from near the top edge of upper section 14*b* downward, and baffle section 66*b* extends from approximately the vertical middle of section 14*b* downward. Baffle sections 66*a*, 66*b* and 66*c* are spaced like baffle sections 46*a*, 46*b* and 46*c* with the sections 66*a* and 66*c* on either side of section 66*b*. The lower ends of sections 66*a*, 66*b* and 66*c* terminate above the bottom of upper section 14*b* an amount equal to the projection of sections 46*a*, 46*b* and 46*c*. Thus, when lower and upper sections 14*a* and 14*b* are assembled, the baffle sections complement each other to form complete baffles 74 and 76 which guide the flue gases in the serpentine path G. Furthermore, since the lower baffle sections extend across the horizontal longitudinal line of juncture of the upper and lower panels, they aid in maintaining the alignment of the panel sections.

Figure 5:
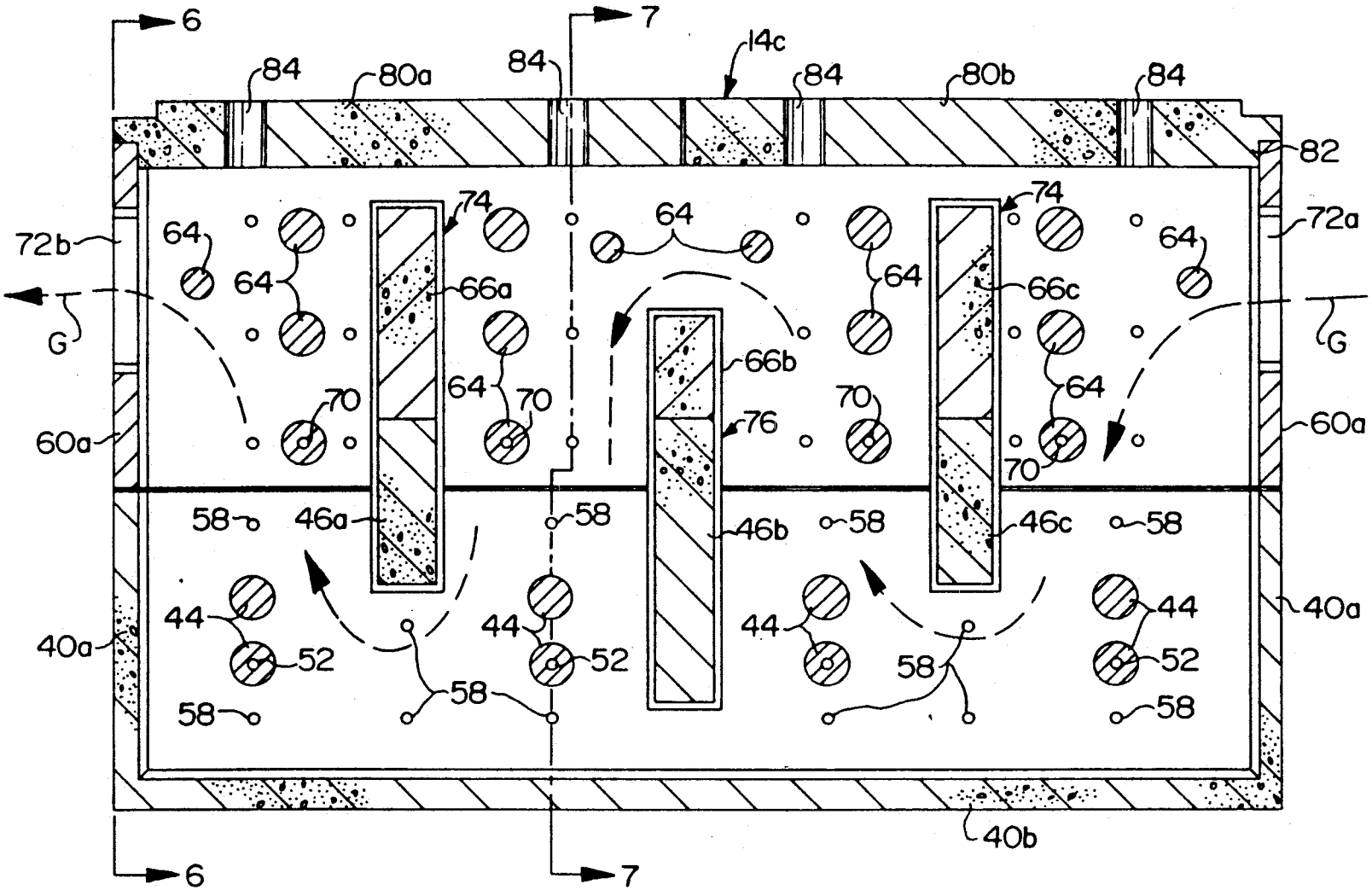
FIG. 5 is a longitudinal sectional view of the flue wall of FIG. 1 in its assembled configuration.
Figure 8:
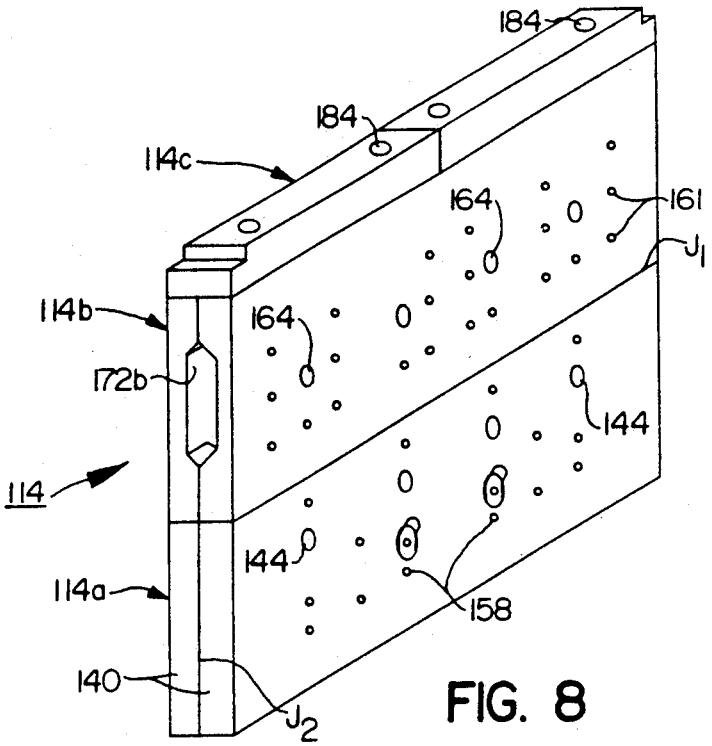
FIG. 8 is an isometric view of another embodiment of the pre-cast flue wall according to the invention.

When sections 14*a*, 14*b* and 14*c* are assembled on-site, the interfaces are filled with mortar to provide air-tight joints. As best seen in FIG. 5, the gases flow from inlet 72*a* in the predetermined, preferably serpentine-like path G from right to left under the lower ends of baffles 74 and over the upper end of baffle 76 to exit 72*b*.

The flue space in upper section 14*b* is enclosed at the top by cover section 14*c* which has two elongate caps 80*a* and 80*b* seated on the rim and abutting end-to-end at the approximate midpoint of section 14*b*. Bosses 82 extending from the bottoms of caps 80*a* and 80*b* fit into the flue space of upper section 14*b* to provide positive alignment therewith. Vertical ports 84 spaced along the length of caps 80*a* and 80*b* extend through to receive fuel burners 28 as may be required for producing a downward flame. Ports 84 not occupied by burners are temporarily plugged by means not shown.

Referring now to the second embodiment of the invention illustrated in FIGS. 8–13, there is shown a precast flue wall 114 comprising coplanar lower and upper sections 114*a* and 114*b*, and a top cover section 114*c*. Lower section 114*a* is constructed of two identical, spaced parallel monolithic refractory panels 140, with inturned interfacing reliefs of complementary portions of end and bottom walls 140*a* and 140*b* , interior supports 142, and elongate vertical baffle sections 146*a*, 146*b* and 146*c* symmetrically arranged about a vertical axis Y-Y. Baffle sections 146*a*, 146*b* and 146*c* are spaced apart along the length of panels 140 with their upper ends projecting above the top, or horizontal line of juncture $J_1$, between panel sections 114*a* and 114*b*. The lower ends of sections 146*a* and 146*c* extend approximately halfway into the flue space from the horizontal line of juncture $J_1$, while baffle section 146*b* extends almost the entire vertical distance between the panels 140.

Figure 12:
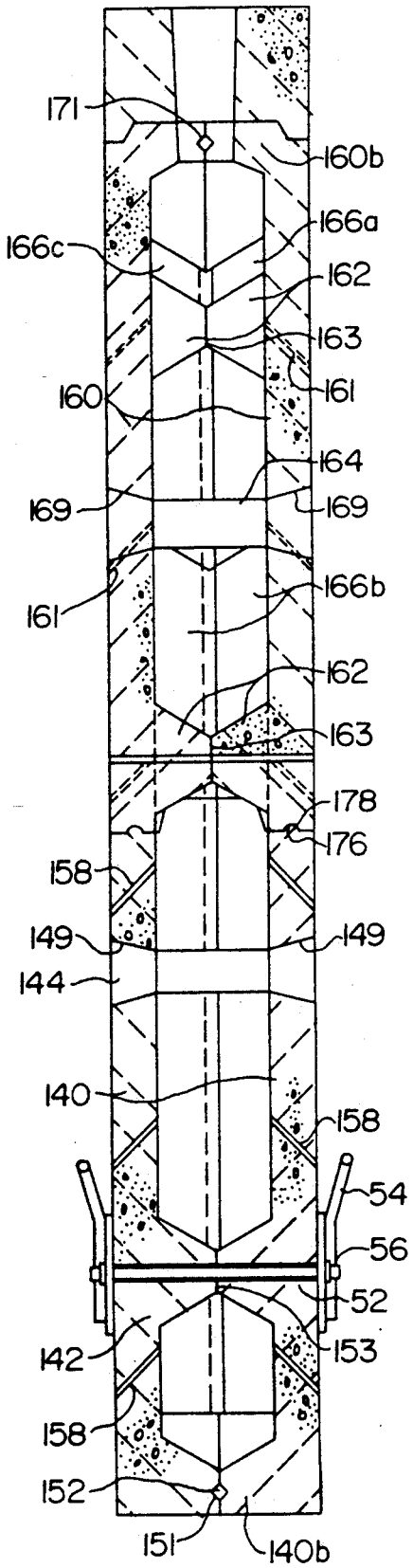
FIG. 12 is a sectional view of the flue wall of FIG. 9 taken along line 12—12 of FIG. 9.
Figure 13:
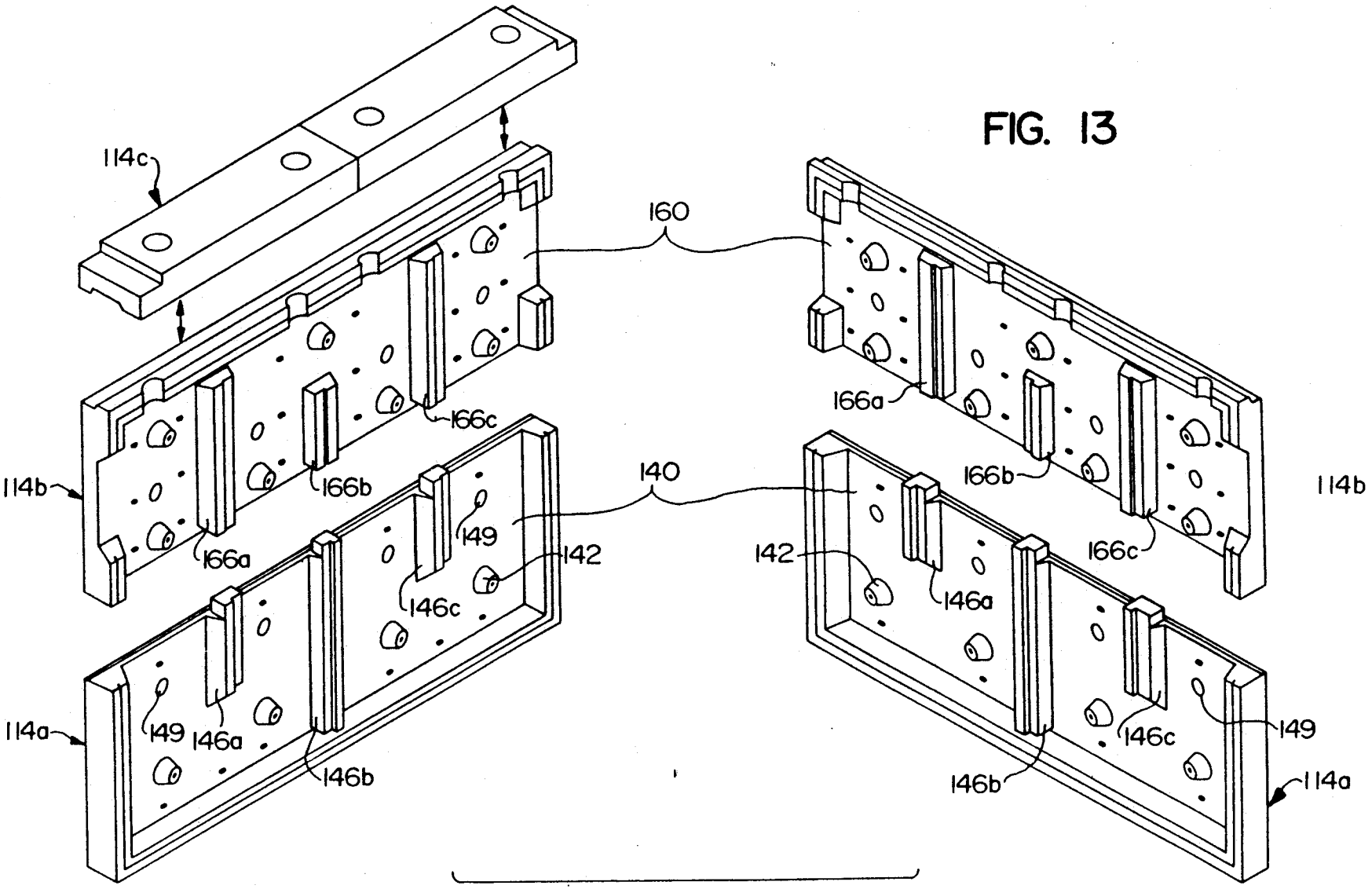
FIG. 13 is an exploded isometric view of the flue wall of FIG. 8.

As shown in FIG. 12, panels 140 are interlocked by crossties 144 which taper outwardly at their ends into correspondingly tapered holes 149 at opposite locations in panels 140. Inner supports 142 are located in areas of high stress at selected positions in panels 140 to provide rigidity against inward collapse. A through-hole 150 in each support 142 enables attachment of components 52, 54 and 56 as described above for lifting the assembled sections 114*a* and 114*b* with a lifting device such as a crane. Weepholes 158, as described with respect to the preceding embodiment, slope upward from the exterior to the interior of panels 140 and provide passages for conducting into the interior of the flue wall any combustible gases given off by the carbon blocks to enable the off-gases to be burned when exposed to hot gases within the flues.

Figure 10:
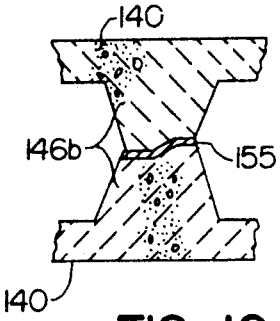
FIG. 10 is a cross sectional view of a baffle section in the flue wall taken along the line 10—10 of FIG. 9.
Figure 9:
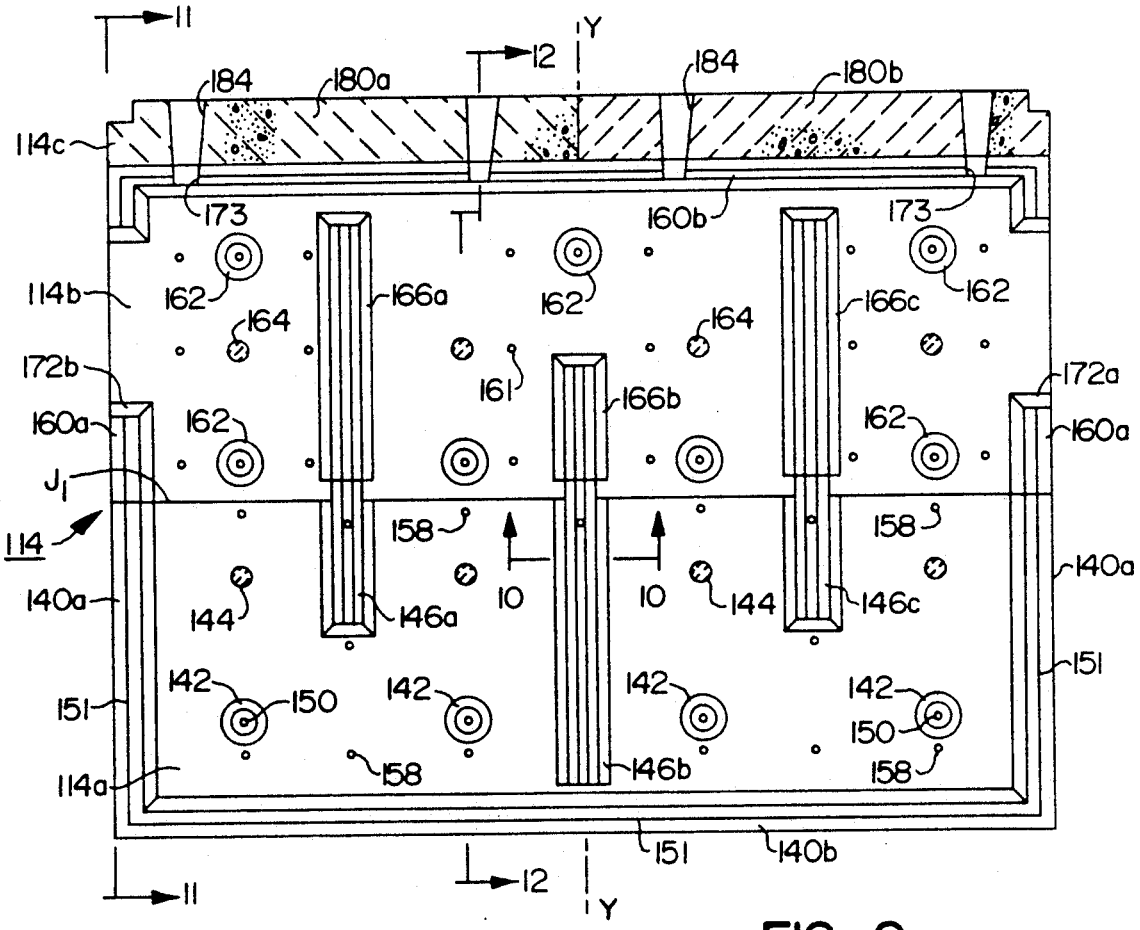
FIG. 9 is a longitudinal view, partially sectioned, of the flue wall of FIG. 8.
Figure 11:
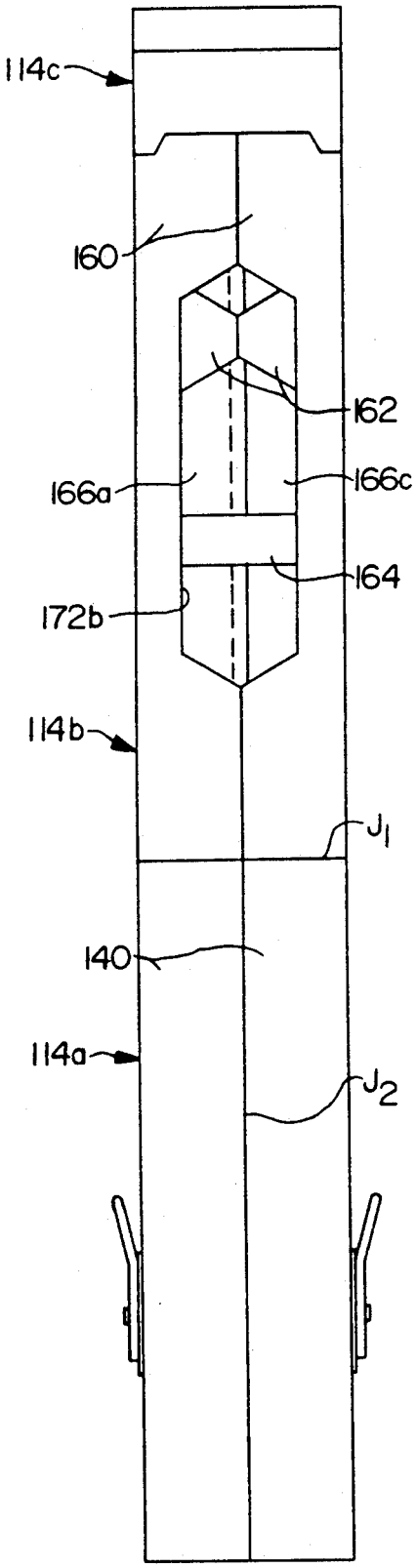
FIG. 11 is an end view of the flue wall taken on the line 11—11 of FIG. 9.

Along the vertical line of juncture $J_2$, the end and bottom walls 140*a* and 140*b* have mortared joints 152 extending along grooves 151 located at the interface between panels 140 when joined together with mortared bonds 153 at support portions 142. As best seen in FIG. 10, the abutting faces of baffles 146*a*, 146*b* and 146*c* have offset surfaces with insulation 155, approximately ½" thick, interposed between them to minimize shearing of solid cross members due to creepage from thermal shock. The offset surfaces cooperate to form a labrynthine path in the horizontal direction to prevent gas from by-passing the desired flow path established by the baffles.

Upper wall section 114*b* is constructed like lower wall section 114*a* of monolithic panels 160 with interfacing reliefs of bonded complementary portions of end and top walls 160*a* and 160*b*, mortared bonds 163 at inner supports 162, and insulated elongate baffle sections 166*a*, 166*b* and 166*c* symmetrically arranged about the vertical axis Y-Y. Crossties 164 are secured at their ends in tapered holes 169, and holes 170 cast through supports 162 receive rods 50 for attachment to lifting lugs 54 in the manner aforedescribed. End walls 160*a* include opposed recesses to form inlet and outlet openings 172*a* and 172*b*, respectively, for allowing the hot gases to flow through the flue space. Top wall 160*b* includes opposed recesses 173 symmetrically spaced about the vertical axis Y-Y forming openings for fuel burners 28 (FIG. 1).

Baffle sections 166*a*, 166*b* and 166*c* are spaced along the length of upper flue wall section 114*b* to align vertically with baffle sections 146*a*, 146*b* and 146*c* respectively when the upper section 114*b* is assembled on top of the lower section 114*a*. Baffle portions 166*a* and 166*c* extend from near the top of wall 160*b* downward toward the horizontal line of juncture $J_1$, and baffle section 166*b* extends from near the vertical middle of section 114*b* downward toward the horizontal line of juncture $J_1$. The lower ends of sections 166*a*, 166*b* and 166*c* terminate above the bottom of upper section 114*b*, i.e. the horizontal line of juncture $J_1$, an amount equal to the projection of sections 146*a* , 146*b* and 146*c* above the line of juncture $J_1$. In this manner the aligned baffle sections interface to form complete baffles, and because they extend across the horizontal line of juncture $J_1$, they assure proper alignment of section 114*b* on top of section 114*a* when they are assembled. Ridges 176 along the top of panels 140 interengage with groove 178 along the bottom edge of panels 160 to facilitate self-alignment when sections 114*a* and 114*b* are assembled, and upwardly and inwardly inclined weepholes 161 provide a passage for flue gases released by the carbon blocks during baking.

Preferably, the cover section 114*c* is separately cast as two identical components 180*a* and 180*b* and accommodates fuel burners at selected ports 184 which co-align with openings 173 in top wall 160*b*.

When the sections 114*a*, 114*b* and 114*c* are assembled on site, the interfaces are mortared both to provide a permanent connection and to provide air-tight joints in the same manner as the first embodiment.

The configuration of each monolithic component of the flue wall of the first embodiment is especially amenable to pre-casting at a remote location and easy transport to a bake oven site. Wall sections 14*a* and 14*b* are each poured in separate steps. Fabrication of lower wall section 14*a* will illustrate the process which is substantially the same for upper wall section 14*b*. In one method a castable refractory component of section 14*a* is poured in a first form lying on its side for the length, height and thickness of panel 40 with consumable forms for the crossties 44 and weepholes 58. After setting, the crosstie forms are removed and a second consumable form is set on top of the first "pour" providing thereby a hollow interior between panels 40 and 42, baffle sections 46*a*, 46*b* and 46*c*, crossties 44, edgewalls 40*a* and 40*b*, and weepholes 58. Castable refractory is then poured into the additional forms, air dried and finally heat cured in a conventional manner. The hollow interior, crosstie and weephole forms are all consumed or lost during curing.

In another preferred process, a castable refractory component of section 14*a* is poured into a horizontally disposed mold of length, height and thickness of panel 42 with consumable forms providing cavities for the crossties 44, baffle sections 46*a*, 46*b* and 46*c*, and weepholes 58. Rods 50, acting as casting cores, are centrally positioned in selected ones of the crossties forms, and are removed after the refractory sets. After setting, the refractory panel 42 is inverted over another mold which is maintained in spaced relation by crossties 44 abutting the bottom of the second mold. Castable refractory is then poured into the mold surrounding the tapered ends of crossties 44. When set, the crossties 44 at holes 49 provide positive interlocking of the panels 40 and 42 to define a wall section which may then be heat cured in a conventional manner.

A preferred process for fabricating lower and upper wall sections 114*a* and 114*b* includes pouring two each of castable panels 140 and 160 with their baffles and vacuum support portions in respective molds. Removable cores provide for crosstie holes 149 and 169 and weepholes 158 and 161. When the castable is set, the crosstie cores are removed and the panels symmetrically bonded with crosstie forms between opposed holes 149 and 169 and insulation 155 between the opposed portions of baffle sections 146*a*, 146*b* and 146*c* by mortar between the opposed portions of supports 142 and end and bottom wall 140*a* and 140*b* to form the hollow flue interior. With insulation paper lining holes 149 and 169, castable refractory is then poured into the crosstie forms, and the assembly thus formed is cured in a conventional manner. The crosstie forms and weephole cores are all consumed or lost during the heat curing process. Panels 140 and 160 may now be transported to the oven site for final assembly with the precast cover components of section 114*c* by mortared joints at their interfaces.

Some of the many advantages of the invention should now be readily apparent. For example, a novel construction is provided in which the flue walls can be pre-cast at a remote location in monolithic upper and lower wall sections for expeditious and economic installation at the baking oven site. Weepholes are substituted for the random cracks occurring in the standard brick construction to provide passages for the gases given off by the carbon blocks to flow into the interior of the flue wall allowing them to be burned with other combustion gases and augment the baking process. Being of monolithic design, no steel work is required under the flue walls for lifting. Lifting rods and lugs facilitate ease of transporting wall sections. The symmetry of the interior design of the flue wall sections in one embodiment enables them to be assembled from identical pairs of panels cast in one mold configuration and permits the opposing panels of each wall section to be pre-cast in the same form. The projecting baffles from one section also provide self-alignment of the sections as they are assembled.

It will be understood that various changes in the details, steps and arrangement of parts, which have been hereby described and illustrated in order to explain the nature of the invention, may be made by those skilled in the art within the principal and scope of the invention as expressed in the appended claims.

We claim:

1. A pre-cast refractory flue wall for cooperating with like walls to form a baking oven, said wall comprising:

upper and lower wall sections joined together in coplanar relation along a horizontal line of juncture extending between upright ends;

each wall section including a complementary pair of wall panels juxtaposed in spaced parallel relation, each panel section having complementary inturned peripheral portions adapted to engage one another along a vertical line of juncture to form a hollow space between said panels, said inturned portions having recesses cooperating to form an inlet at one of said ends and an outlet at the other of said ends;

each panel section having a plurality of integral baffles adapted to engage one another along said vertical line of juncture for causing flue gas to flow in a predetermined flow path across said horizontal line of juncture from said inlet to said outlet, said baffles in at least one of said wall panels extending across said horizontal line of juncture for maintaining said wall sections in coplanar relation when assembled;

means for permanently securing said panels together in said juxtaposition and said wall section in said coplanar relation;

means in at least one of said wall panels providing a plurality of weepholes for permitting gas to flow across said one wall panel; and means extending across the wall panels in said lower wall section for enabling the wall to be transported after assembly;

whereby flue gas entering the inlet is directed by the baffles interiorily of the wall while other gas may flow through the weepholes and mix with the flue gas before exiting the outlet.

2. A pre-cast refractory flue wall according to claim 1 wherein:

said wall panels in each wall section are identical to one another, being symmetrical with respect to an axis disposed perpendicular to said horizontal line of juncture and located equivalent out between said ends.

3. A pre-cast refractory flue wall according to claim 1 including auxiliary inner supports extending between said walls interiorily thereof.

* * * * *